US006284680B1

(12) United States Patent
Aikawa et al.

(10) Patent No.: US 6,284,680 B1
(45) Date of Patent: Sep. 4, 2001

(54) NONWOVEN FABRIC CONTAINING FINE FIBERS, AND A FILTER MATERIAL

(75) Inventors: Toshio Aikawa; Noriko Miyaguchi; Takashi Tarao, all of Ibaraki; Hitoshi Kobayashi, Shiga, all of (JP)

(73) Assignee: Japan Vilene Company, Tokyo (JP)

( * ) Notice: Subject to any disclaimer, the term of this patent is extended or adjusted under 35 U.S.C. 154(b) by 0 days.

(21) Appl. No.: 09/441,791

(22) Filed: Nov. 17, 1999

(30) Foreign Application Priority Data

Nov. 17, 1998 (JP) ..... 10-326996
Nov. 30, 1998 (JP) ..... 10-339858
Mar. 19, 1999 (JP) ..... 11-074756

(51) Int. Cl.[7] ..... D04H 1/00; D04H 3/00
(52) U.S. Cl. ..... 442/363; 442/340; 442/361; 442/411
(58) Field of Search ..... 428/373; 442/344, 442/364, 411, 340, 361, 363

(56) References Cited

U.S. PATENT DOCUMENTS 5,124,194 * 6/1992 Kawano ..... 428/373

FOREIGN PATENT DOCUMENTS

40936730A * 12/1997 (JP) .
410325059A * 12/1998 (JP) .
411269723A * 10/1999 (JP) .
12-160432A * 6/2000 (JP) .
12-192335A * 7/2000 (JP) .

* cited by examiner

*Primary Examiner*—N. Edwards
(74) *Attorney, Agent, or Firm*—Darby & Darby

(57) ABSTRACT

A nonwoven fabric prepared from fibers which are not substantially fibrillated and have a diameter of less than 20 μm, by fusing a fiber web comprising fine fibers having a diameter of 4 μm or less, and adhesive fibers having a diameter ranging from 8 μm to less than 20 μm, wherein a maximum pore size in the nonwoven fabric is not more than twice the mean flow pore size of the nonwoven fabric is disclosed.

6 Claims, 1 Drawing Sheet

NONWOVEN FABRIC CONTAINING FINE FIBERS, AND A FILTER MATERIAL

BACKGROUND OF THE INVENTION

1. Field of the Invention

The present invention relates to a nonwoven fabric containing fine fibers, and a filter material comprised of the nonwoven fabric. The present invention also relates to a fiber capable of generating fine fibers, the fine fibers generated therefrom, and a fiber sheet comprised of the fine fibers.

2. Description of the Related Art

A filter material acts to separate undesired solids, and a filter material comprised of a nonwoven fabric is widely used. The pore sizes of the filter material are preferably uniform, to ensure reliable consistency in filtration. Accordingly, the filter materials is preferably a nonwoven fabric prepared by a wet-laid method.

A nonwoven fabric prepared by forming a fiber web by a wet-laid method, and treating the fiber web with a water jet to entangle the web, is disclosed in, for example, Japanese Unexamined Patent Publications No. 2-6651, No. 3-14694, No. 4-222263, No. 4-240253, and No. 4-316653. The treatment with a water jet is carried out to impart strength to a nonwoven fabric. However, the water-jet treatment has a disadvantage in that a uniform texture of the fiber web is disturbed by the water-jet whereby a distribution of the pore sizes in the nonwoven fabric is made non-uniform and thus a desired filtering performance is lost.

Japanese Unexamined Patent Publications No. 63-232814 and No. 3-12208 disclose a nonwoven fabric which is prepared by a wet-laid method and contains fibrillated fibers. It is expected that the use of the fibrillated fibers brings about a bonding of fibers and thus enhances the denseness. However, the fibrillated fibers are liable to be entangled with each other, and therefore, it is difficult to disperse the fibrillated fibers in water as a dispersing medium and to prepare a nonwoven fabric having an excellent texture.

Further, when the fiber web is prepared by a wet-laid method, the fibrillated fibers are entangled with wires on which fibers are laid, and thus, when the laid web is peeled from the wire, the texture of the fiber web is deteriorated or a part of the fibers remains on the wires. Therefore, it is difficult to produce a nonwoven fabric having the desired properties.

Further, Japanese Unexamined Patent Publication No. 59-228918 discloses a wet-laid nonwoven fabric comprising 20 mass % or more of fine fibers having an average fiber diameter of 0.1 to 3 $\mu$m, 20 mass % or more of intermediate fibers having a fiber diameter of 5 to 15 $\mu$m, and 20 mass % or more of thick fibers having a fiber diameter of 20 to 50 $\mu$m. In the nonwoven fabric, however, the presence of the thick fibers disturbs an orientation of the fibers, and large pores are formed in the vicinity of the thick fibers. Therefore, a distribution of the pore sizes becomes non-uniform and a desired filtering-performance is not obtained.

Further, it is believed that a separating performance of a filter material can be enhanced as an average diameter of fibers constituting the filter material becomes smaller. For example, a filter material composed of fine fibers having a diameter of about 5 $\mu$m or less can effectively separate fine solids. Therefore, a diameter of the fibers for a filter material is preferably as fine as possible. The fine fiber preferably contains polypropylene because of a chemical resistance or an property.

A filter material comprising polypropylene fine fibers can be prepared, for example, by spinning islands-in-sea type fibers containing polypropylene island components, cutting the fibers into appropriate lengths, dissolving and removing the sea component, forming a fiber web from the island components, and bonding the fiber web. In the process as above, however, as the diameter of the polypropylene fibers becomes smaller, the island components are liable to bond with each other at cut surfaces due to a pressure applied when the islands-in-sea type fibers are cut. As a result, it is difficult to obtain a fiber web having a uniform texture and thus, to obtain a filter material having a uniform texture. Such an undesirable tendency is significant when the diameter of the island components is 2 $\mu$m or less.

SUMMARY OF THE INVENTION

Accordingly, the object of the present invention is to remedy the above disadvantages of the conventional filter material, and to provide a nonwoven fabric having a narrow distribution of pore sizes and a good texture, and exhibiting an excellent filtering performance.

Another object of the present invention is to provide a filter material composed of such a nonwoven fabric.

A still further object of the present invention is to remedy the above disadvantages of the conventional islands-in-sea type fibers, and to provide a fiber capable of generating fine fibers without a bonding thereof by a pressure applied when cutting the parent fiber.

A still further object of the present invention is to provide fine fibers formed from such parent fibers, and a fiber sheet composed of the generated fine fibers.

Other objects and advantages of the present invention will be apparent from the following description.

In accordance with the present invention, there is provided a nonwoven fabric prepared from fibers which are not substantially fibrillated and have a diameter of less than 20 $\mu$m, by fusing a fiber web comprising fine fibers having diameters of 4 $\mu$m or less, and adhesive fibers having a diameter ranging from 8 $\mu$m to less than 20 $\mu$m, wherein a maximum pore size in the nonwoven fabric is not more than twice the mean flow pore size of the nonwoven fabric.

In accordance with the present invention, there is also provided a filter material composed of the above nonwoven fabric.

Further, in accordance with the present invention, there is provided a fiber capable of generating fine fibers having a diameter of 5 $\mu$m or less and containing a high-melting-point polypropylene component with a melting point of 166° C. or more. The fiber capable of generating fine fibers will be sometimes referred to as a fine-fibers-generating parent fiber or a parent fiber.

Still further, in accordance with the present invention, there is provided a fine fiber having a diameter of 5 $\mu$m or less and containing the high-melting-point polypropylene component with a melting point of 166° C. or more, i.e., a fine fiber generated from the parent fiber.

Still further, in accordance with the present invention, there is provided a fiber sheet containing the fine fibers.

DESCRIPTION OF THE PREFERRED EMBODIMENTS

Figure 1:
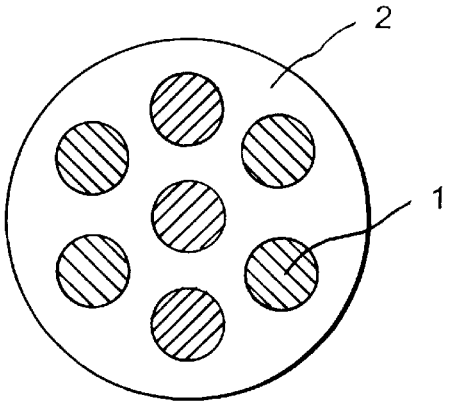
FIG. 1 schematically illustrates a cross-sectional structure of one embodiment of the fine-fibers-generating parent fiber according to the present invention.

The nonwoven fabric of the present invention is prepared from fibers which are not substantially fibrillated, so that a uniform dispersibility of the fibers is enhanced, and an entanglement of the fibers with wires used for laying the fibers is avoided during the production of the nonwoven fabric. In the present invention, the use of the fibers not substantially fibrillated makes it possible to obtain a nonwoven fabric having a good texture, and exhibiting an excellent filtering performance. The term "fibers not substantially fibrillated" as used herein means fibers not bonding with each other. Examples of "fibrillated fibers" are fibers composed of many fibers branched from a fiber (such as fibers or pulp beaten by a beater) or fibers having a network structure composed of many fibers (such as fibers prepared by a flash spinning). These "fibrillated fibers" are not involved in the "fibers not substantially fibrillated" used in the present invention.

The nonwoven fabric of the present invention is prepared from the fibers having a diameter of less than 20 μm, preferably 18 μm or less, to avoid a disturbance of the fiber orientation caused by the existence of thick fibers. Namely, the nonwoven fabric of the present invention does not substantially contain fibers having a diameter of 20 μm or more. The term "diameter" of a fiber having a circular cross-section means a diameter of the circle, and the "diameter" of a fiber having a non-circular cross-section means a diameter of a hypothetical circle having an area the same as that of the non-circular cross-section.

More particularly, the nonwoven fabric of the present invention comprises (1) fine fibers having a diameter of 4 μm or less, and (2) adhesive fibers having a diameter ranging from 8 μm to less than 20 μm. The fine fibers mainly function to form pores having uniform pore sizes due to a uniform dispersion. Therefore, the diameter of the fine fiber must be 4 μm or less. If a sufficient amount of fibers having a diameter of 4 μm or less is not contained in the non-woven fabric, it becomes difficult to form pores having uniform pore sizes. There is no particular lower limit to the diameter of the fine fibers, but preferably the diameter of the fine fibers is 0.1 μm or more. This is because fine fibers having a diameter of 0.1 μm or more are not easily detached from the wire during the production of a fiber web and thus a designed fiber web can be easily obtained. The diameter of the fine fibers ranges preferably from 0.3 to 4 μm, more preferably 0.5 to 3 μm, most preferably 0.75 to 3 μm.

In the present invention, fine fibers having a uniform diameter are preferably used to form pores having a uniform size. According to the preferred embodiment of the present invention, a ratio (Sf/Af) of a standard deviation (Sf) of a fiber size distribution of the fine fibers to an average (Af) of the diameter of the fine fibers is 0.2 or less, more preferably 0.18 or less. When all of the fine fibers used have the same diameter, the standard deviation (Sf) of a fiber size distribution is 0, and so the ratio (Sf/Af) also becomes 0. That is, the lower limit of the ratio (Sf/Af) is 0. The average (Af) of the diameter of the fine fibers is determined by taking an electron photomicrograph of the nonwoven fabric, measuring diameters of 100 or more fine fibers, and calculating the average value thereof. The standard deviation (Sf) is calculated from the equation (1):

$$Sf=\{(n\Sigma_{\chi}^{2}-(\Sigma_{\chi})^{2})/n(n-1)\}^{1/2} \quad (1)$$

wherein Sf denotes a standard deviation, n denotes the number of the fine fibers measured, and $\chi$ denotes a diameter of each of the fine fibers measured. When the nonwoven fabric of the present invention contains two or more kinds of the fine fibers having a diameter of 4 μm or less, each of the fine fibers preferably satisfies the ratio (Sf/Af) as defined as above. Further, each of the fine fibers preferably has a diameter substantially unchanged in an axial direction so that pores having uniform pore sizes can be formed.

The preferred fine fibers having almost the same diameter can be prepared, for example, by carrying out a conjugate spinning process, such as a process wherein island components are extruded from restricted nozzles at a spinning nozzle into a sea component, so as to form islands-in-sea type fibers, and then dissolving the sea components to remove them from the fibers. It is difficult to produce islands-in-sea type fibers capable of generating fine fibers having almost the same diameter by a polymer blend spinning process wherein a resin for an island component and a resin for a sea component are admixed, the mixture is spun, and the sea component is dissolved and removed.

The material for the fine fiber is not particularly limited, but the fine fiber may be made of, for example, a polyamide, such as nylon 6, nylon 66 or a nylon-based copolymer, a polyester, such as polyethylene terephthalate, a polyethylene terephthalate-based copolymer, polybutylene terephthalate, or a polybutylene terephthalate-based copolymer, a polyolefin, such as polyethylene, polypropylene, or poly-4-methyl-1-pentene, or an olefin copolymer, polyurethane, or a vinyl polymer, or a combination thereof.

A preferred fine fiber which may be used in the present invention may contain an adhesive component which can take part in a fusion of the constituent fibers of the nonwoven fabric. When the fine fibers containing the adhesive component are used, the fine fibers are firmly fixed by the adhesive component to thereby prevent a detaching of the fine fibers or the raising of a nap. The fine fiber may be composed of only the adhesive component or of two or more components, namely one or more adhesive components and one or more non-adhesive components having a melting point higher than that of the adhesive component. In the preferred embodiment of the nonwoven fabric of the present invention, the fine fiber contains two or more components, namely, one or more adhesive components and one or more non-adhesive components so that the inherent function of the fine fibers of forming uniform pores is not hindered and a structure of fibers may be maintained after the fine fibers are fused. Preferably, the adhesive component contained in the fine fiber is arranged at least on a surface of the fine fiber. In. this case, the cross-section of the fine fiber may be, for example, a sheath-core type, an eccentric type, a side-by-side type, an islands-in-sea type, an orange type or a multiple bimetal type. More preferably, the surface of the fine fiber is completely covered with the adhesive component. In this case, the cross-section of the fine fiber may be, for example, a sheath-core type, an eccentric type, or an islands-in-sea type.

The melting point of the non-adhesive component is higher than that of the adhesive component, preferably by 10° C. or more, more preferably by 20° C. or more, to thereby maintain the shape of the fine fibers. Further, the melting point of the non-adhesive component is higher than the temperature of fusing treatment with the adhesive fibers, preferably by 10° C. or more, more preferably by 20° C. or more, to thereby maintain the shape of the fine fibers during the fusing treatment. The fine fibers containing two or more adhesive and non-adhesive components may be prepared, for example, by spinning islands-in-sea type fibers in a conventional conjugate spinning process, using a spinning nozzle having a desired profile, such as a sheath-core type, an eccentric type, a side-by-side type, an islands-in-sea type, an orange type or a multiple bimetal type profile, and then removing the sea component.

The term "melting point" as used herein means a temperature giving a maximum value in a melting-endotherm curve obtained by raising the temperature at a rate of 10° C./minute from room temperature in a differential scanning calorimeter. When two or more maximum values are obtained in the melting-endotherm curve, the term "melting point" as used herein means the highest value.

The fine fiber used in the present invention may be crimpable or dividable. The crimpable fine fiber may be of the eccentric type, or side-by-side type cross-sectional shape. The dividable fine fiber may be of the islands-in-sea type, orange type or multiple bimetal type cross-sectional shape.

The preferred fine fiber is a short fiber having a high degree of freedom in a dispersion medium and thus is easy to be uniformly dispersed as mentioned below. Therefore, the fine fibers or the islands-in-sea type fibers are generally cut into short fibers. If the fine fibers or island components in the islands-in-sea type fibers are bonded with each other by the pressure applied upon cutting, the resulting fibers have a structure similar to fibrillated fibers, and thus it is difficult to produce a nonwoven fabric having a narrow distribution of pore sizes and an excellent texture. Therefore, it is preferable to use fine fibers which are not bonded with each other by the pressure applied upon cutting, for example, fine fibers made of a polymeric material having a high crystallizability, such as polymethylpentene, or polypropylene having a melting point of 166° C. or more, preferably 168° C. or more. It is also preferable to use islands-in-sea type fibers containing island components which are not easily bonded with each other by the pressure applied upon cutting, for example, islands-in-sea type fibers containing island components made of a polymeric material having a high crystallizability, such as polymethylpentene, or polypropylene having a melting point of 166° C. or more, preferably 168° C. or more.

The nonwoven fabric of the present invention contains the adhesive fibers. The adhesive fibers have the functions of fixing the fine fibers by fusion, and mainly, imparting a desired strength to the nonwoven fabric. Therefore, the adhesive fibers used are thicker than the fine fibers, and the diameter thereof must be 8 $\mu$m or more. Further, the diameter of the adhesive fibers must be less than 20 $\mu$m, to prevent a disturbance of the orientation of the fine fibers due to the presence of the thick adhesive fibers when the fiber web is formed. The diameter of the adhesive fibers preferably ranges from 8 to 18 $\mu$m.

The adhesive fiber may be composed only of a simple component. However, the adhesive fiber is preferably composed of two or more resin components, because the fiber structure thus may be maintained after fused, and a desirable strength obtained. The cross-section of the adhesive fiber containing two or more resin components may be, for example, a sheath-core type, an eccentric type, a side-by-side type, an islands-in-sea type, an orange type or a multiple bimetal type. The preferred adhesive fiber contains a large amount of the adhesive component which may take part in the fusion, in the form of the sheath-core type, eccentric type or islands-in-sea type cross-section. Such adhesive fibers are commercially available or may be easily prepared by a conventional conjugate spinning process or polymer blend spinning process.

The adhesive fibers may be made of a resin material used for preparing the fine fibers. When the fine fibers are not to be fused, the adhesive component contained in the adhesive fiber has a melting point lower than that of the fine fiber, preferably by 10° C. or more, more preferably 20° C. or more, so that the fine fibers are not melted by the heat applied when fusing the adhesive fibers. When the adhesive component contained in the fine fibers is to be fused at the same time, the difference between the melting points of the adhesive component of the fine fiber and the adhesive component of the adhesive fiber is preferably 35° C. or less, more preferably 30° C. or less, so that both components are firmly fused. When the difference between the melting point of the adhesive component contained in the adhesive fiber and the melting point of the adhesive component contained in the fine fiber (or the lowest melting point of two or more adhesive components contained in the fine fiber) is 10 to 35° C., it is possible to fuse or not fuse the fine fibers. When the fine fiber contains one or more adhesive components and one or more non-adhesive components, the melting point of the adhesive component contained in the adhesive fiber is lower than that of the non-adhesive component (or the lowest melting point of the non-adhesive components) of the fine fiber, preferably by 10° C. or more, more preferably by 20° C. or more, so as to maintain the shapes of the fine fibers. When the adhesive fiber contains two or more resin components, a melting point of the non-adhesive resin component is higher than that of the adhesive resin component, preferably by 10° C. or more, more particularly by 20° C. or more, so as to maintain the shapes of the adhesive fibers under the heat applied during the fusing treatment.

A mass ratio of the fine fibers and the adhesive fibers contained in the nonwoven fabric of the present invention varies with the purpose, the application and/or desired properties of the nonwoven fabric. However, the mass ratio (the fine fibers:the adhesive fibers) is preferably 30:70 to 70:30, more preferably 35:65 to 65:35. When the fine fibers are contained in an amount of 30 mass % or more with respect to the total mass of the nonwoven fabric, the nonwoven fabric having a narrow distribution of pore sizes can be easily obtained. When the adhesive fibers are contained in an amount of 30 mass % or more with respect to the total mass of the nonwoven fabric, the fine fibers can be firmly fixed and thus not easily detached, and further, a desired strength can be imparted to the nonwoven fabric.

The nonwoven fabric of the present invention may contain intermediate fibers having a diameter ranging from more than 4 $\mu$m to less than 8 $\mu$m, in addition to the fine fibers and the adhesive fibers. The intermediate fibers may be contained in the nonwoven fabric in an amount of preferably 40 mass % or less, more preferably 30 mass % or less, with respect to the total mass of the nonwoven fabric.

In one embodiment of the present invention, the nonwoven fabric comprises 30 to 70 mass % (preferably 35 to 65 mass %) of the fine fibers having a diameter of 4 $\mu$m or less and 70 to 30 mass % (preferably 65 to 35 mass %) of the thick adhesive fibers having a diameter of from 8 $\mu$m to less than 20 $\mu$m. In another embodiment of the present invention, the nonwoven fabric comprises 30 to 70 mass % (preferably 35 to 65 mass %) of the fine fibers having a diameter of 4 μm or less, 0 to 40 mass % (preferably 0 to 30 mass %) of the intermediate fibers having a diameter of from more than 4 μm to less than 8 μm, and 70 to 30 mass % (preferably 65 to 35 mass %) of the thick adhesive fibers having a diameter of from 8 μm to less than 20 μm.

The constituent fibers, namely the fine fibers, the thick adhesive fibers, and optionally, the intermediate fibers, of the nonwoven fabric according to the present invention may be undrawn fibers but preferably are drawn fibers as these impart a desired strength to the nonwoven fabric. A fiber length of the constituent fibers is not particularly limited, but is preferably 0.5 to 30 mm. The constituent fibers are preferably prepared by being cut into short fibers having a fiber length of 0.5 to 30 mm. This is because as the fiber length becomes shorter, the degree of freedom of the fibers becomes higher, and thus the fibers may be uniformly dispersed. Further, when the fiber web is prepared by a wet-laid method, suitable for a uniform dispersion of the fibers, shorter fibers are preferably used. The term "fiber length" as used herein means a length measured in accordance with JIS (Japanese Industrial Standard) L 1015, a method B for test of a chemical staple fiber.

The nonwoven fabric of the present invention is composed of the above fibers and has a narrow distribution of the pore sizes formed therein. More particularly, a maximum pore size in the nonwoven fabric is not more than twice (preferably 1.9 times) a mean flow pore size of the nonwoven fabric. In an ideal embodiment, a maximum pore size is same as the mean flow pore size; namely, all of the pores have the same size. The "mean flow pore size" is defined in ASTM-F316. The maximum pore size is measured in accordance with a bubble point process, and the mean flow pore size is measured in accordance with a mean flow point process.

The nonwoven fabric of the present invention preferably contains the constituent fibers laid in a substantially 2-dimensional state. When the constituent fibers are laid 2-dimensionally in the nonwoven fabric, the fibers are regularly arranged, and the distribution of the pore sizes can be narrowed. The term "fiber laid 2-dimensionally" as used herein means that there is substantially no fiber oriented in the direction of the thickness of the fabric. For example, the "fiber laid 2-dimensionally" may be formed by preparing a fiber web by a wet-laid method and fusing the fiber web with adhesive fibers, without treating with a fluid stream such as a water jet.

The nonwoven fabric of the present invention may be prepared, for example, by the following process: As the starting fibers, at least the fine fibers and adhesive fibers are used. The fine fibers having almost the same diameter, i.e., the fine fibers wherein a ratio (Sf/Af) of the standard deviation (Sf) of the fiber size distribution of the fine fibers to the average (Af) of the diameter of the fine fibers is preferably 0.2 or less (more preferably 0 to 0.18), are preferably used, so that a nonwoven fabric having a narrow distribution of the pore sizes thereof and exhibiting an excellent filtering-performance may be easily obtained. The starting fibers (i.e., the fine fibers, adhesive fibers, and optionally, the intermediate fibers) having fiber lengths of 0.5 to 30 mm are preferably used, because a fiber web is preferably prepared in a wet-laid method. When the starting fibers (i.e., the fine fibers, adhesive fibers, and optionally, the intermediate fibers) which are not easily bonded with each other by the pressure applied upon cutting are used, a nonwoven fabric having a narrow distribution of the pore sizes and exhibiting an excellent filtering-performance can be easily obtained.

A fiber web is prepared from the above starting fibers by a conventional wet-laid method. The fibers used are not substantially fibrillated, and thus can be uniformly dispersed in water as a dispersing medium. Further, the above starting fibers are not easily entangled with the wires on which the fibers are laid, and thus, a desired nonwoven fabric having an excellent texture can be obtained. During the process of the preparation of the fiber web, a thickener may be added to maintain a uniform dispersion of the fibers. Also, a surface-active agent may be added to enhance an affinity of the starting fibers for water, particularly when the starting fibers contain a component having a low affinity for water. Further, an antifoam agent may be added to remove foam produced by stirring or the like. The addition of such agents may enhance the dispersibility of the fibers, and thus facilitate the obtaining of a nonwoven fabric having a narrow distribution of the pore sizes and exhibiting an excellent filtering-performance.

The resulting fiber web is then dried. During or after the drying, the fiber web is heated to a temperature at which the adhesive component contained in the adhesive fibers, and optionally, one or more adhesive components contained in the fine fibers are fused, with or without pressure, to fuse the adhesive component contained in the adhesive fibers, and optionally, one or more adhesive components contained in the fine fibers, and obtain the nonwoven fabric of the present invention. As above, the nonwoven fabric of the present invention is prepared by fusing the adhesive component contained in the adhesive fibers, and optionally, one or more adhesive components contained in the fine fibers, without treatment with a fluid stream, such as a water jet, and thus the constituent fibers are not 3-dimensionally arranged, but laid 2-dimensionally therein. Therefore, the nonwoven fabric having a narrow distribution of the pore sizes and exhibiting an excellent filtering-performance can be easily obtained.

In the present invention, the constituent fibers are fixed by fusion, instead of the use of fibrillated fibers or an entanglement with a water jet as in the prior art, whereby any disadvantageous defects can be remedied. Further, in the present invention, the nonwoven fabric is prepared by fusing the fibers having a diameter of less than 20 μm to thereby obtain a narrow pore-size distribution which cannot be obtained when the water-jet is carried out; namely a narrow pore-size distribution wherein a maximum pore size is not more than twice a mean flow pore size can be obtained.

The nonwoven fabric of the present invention has a narrow distribution of pore sizes and a good texture, as above, and therefore is suitable for use as a filter material. The filter material may be used as a gas filter which separates solids from gas, or preferably, as a liquid filter which separates solids from liquid. Before use as the filter material, the nonwoven fabric of the present invention is preferably subjected to a calendering treatment to thereby enhance a density and a smoothness of the surface, a physical or chemical treatment to thereby impart or enhance hydrophilicity, or to an adhering treatment of a surface-active agent, such as acetylene glycol, to thereby impart or enhance hydrophilicity. The filter material preferably has an area density of about 5 to 200 $g/m^2$, a thickness of about 0.005 to 2 mm, and an apparent density of about 0.2 to 0.7 $g/cm^3$.

The filter material of the present invention may be used in any form, for example, in the form of a plate, or after folding into a concertina form. Further, the filter material of the present invention may be used singly as above or in combination with one or more other filter materials or one or more spacers, to provide layers having different densities. The filter material of the present invention may be used in a cartridge filter, for example, in the form of a filter material wrapped around a porous cylinder, and/or a concertina folded filter material disposed around a porous cylinder.

The nonwoven fabric of the present invention has a narrow distribution of the pore sizes and exhibits a good texture as above, and therefore may be used, besides use as a filter material, as a separator for a battery such as a lithium ion secondary battery, a nickel-hydrogen secondary battery, or a nickel-cadmium secondary battery, a cleaning cloth, a medical covering fabric, a waterproof fabric having a permeability to water vapor, an interlining cloth, a facing textile material, a substrate for a synthetic leather, a substrate for a synthetic leather with a grain surface, or the like. The nonwoven fabric of the present invention may be subjected to a coloring treatment with a dye or pigment, a nap-raising treatment, a laminating treatment, a fabricating treatment, an embossing treatment, a treatment imparting a water repellancy or hydrophilicity, an electret treatment, a treatment adhering a functional material, such as a surface-active agent, a hydrophilicity-imparting agent, or a water repellancy-imparting agent, a chemical or physical surface treatment, or the like, to impart various functions suitable for an intended application.

The fine-fibers-generating parent fiber of the present invention contains a high-melting-point polypropylene component having a melting point of 166° C. or more. The high-melting-point polypropylene having a melting point of 166° C. or more has a desirable rigidity, probably due to a high crystallizability thereof. It was found by the inventors that, when the parent fibers containing the high-melting-point polypropylene having a melting point of 166° C. or more are cut, the high-melting-point polypropylene components are not bonded with each other.

The fine fibers generated from the parent fibers contain the high-melting-point polypropylene components. Therefore, the fine fibers are not bonded with each other when cut into shorter fibers, and the cut fine fibers are not bonded with each other. Namely, the fine fibers generated from the parent fibers can be uniformly dispersed after cutting. The fiber sheet comprising such fine fibers which are uniformly dispersed exhibits an excellent texture.

The fine-fibers-generating parent fiber of the present invention contains the high-melting-point polypropylene having a melting point of 166° C. or more. A general polypropylene has a melting point of about 160° C., whereas the high-melting-point polypropylene contained in the fine-fibers-generating parent fiber of the present invention has a melting point of 166° C. or more, and thus a high crystallizability. It is believed that, as the crystallizability of the high-melting-point polypropylene becomes higher, the rigidity becomes higher, and thus the bonding due to a pressure applied upon cutting can be more easily prevented. Therefore, the melting point of the high-melting-point polypropylene is preferably 168° C. or more. The high-melting-point polypropylene may contain one or more polyolefin components, such as ethylene, as copolymer components.

As above, the melting point of the high-melting-point polypropylene means a temperature giving a maximum value in a melting-endotherm curve obtained by raising a temperature at a rate of 10° C./minute from room temperature in a differential scanning calorimeter. When two or more maximum values are obtained in the melting-endotherm curve, the "melting point" means the highest value.

The high-melting-point polypropylene may be contained in the fine-fibers-generating parent fiber of the present invention in an amount of preferably 5 mass % or more, more preferably 10 mass % or more, to prevent the bonding upon cutting. The higher limit of the content of the high-melting-point polypropylene is not particularly limited, but is a preferable 90 mass %, to ensure the generation of the fine fibers.

Figure 2:
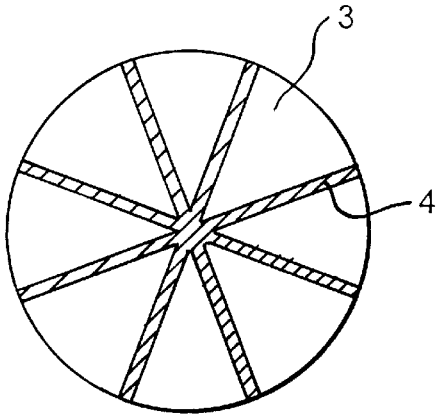
FIG. 2 schematically illustrates a cross-sectional structure of another embodiment of the fine-fibers-generating parent fiber according to the present invention.
Figure 3:
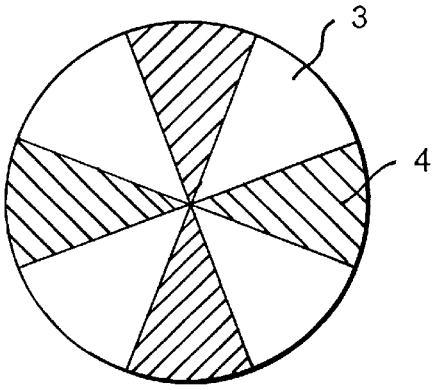
FIG. 3 schematically illustrates a cross-sectional structure of still another embodiment of the fine-fibers-generating parent fiber according to the present invention.
Figure 4:
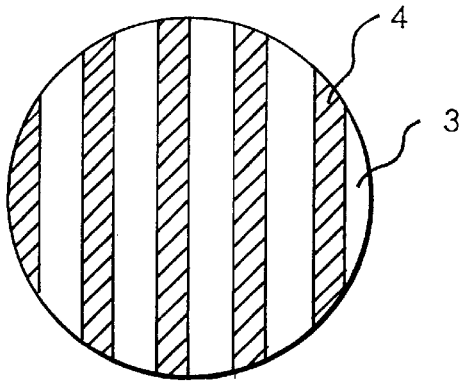
FIG. 4 schematically illustrates a cross-sectional structure of still another embodiment of the fine-fibers-generating parent fiber according to the present invention.

The arrangement or location of the high-melting-point polypropylene components in the fine-fibers-generating parent fiber is not particularly limited. For example, the high-melting-point polypropylene components may be contained as island components 1 or sea component 2 in the islands-in-sea type conjugate fiber as shown in FIG. 1, as first components 3 or second components 4 in the orange type conjugate fiber as shown in FIG. 2 or FIG. 3, or as first components 3 or second components 4 in the multiple bimetal type conjugate fiber as shown in FIG. 4. The high-melting-point polypropylene components are preferably contained as the island components 1 in the islands-in-sea type conjugate fiber as shown in FIG. 1.

When the high-melting-point polypropylene components are contained as the island components in the islands-in-sea type conjugate fiber, the diameter of the island component is 5 $\mu$m or less, to thus generate fine fibers having a diameter of 5 $\mu$m or less. Further, when the high-melting-point polypropylene components are contained as the first or second components in the orange type or multiple bimetal type conjugate fiber, the diameter of a hypothetical circle having an area the same as that of the first or second components is 5 $\mu$m or less, to thus generate fine fibers having a diameter of 5 $\mu$m or less. When the diameter of the island components in the islands-in-sea type conjugate fiber or the diameter of the first or second components in the orange type or multiple bimetal type conjugate fiber is 2 $\mu$m or less, the conjugate fibers can be cut into shorter fibers without the bonding caused when a pressure is applied.

The high-melting-point polypropylene component as the island component in the islands-in-sea type conjugate fiber or as the first or second component in the orange type or multiple bimetal type conjugate fiber may be composed only of the high-melting-point polypropylene or may contain one or more polymeric materials other than the high-melting-point polypropylene. For example, when the high-melting-point polypropylene component contains a polymer having a melting point lower than that of the high-melting-point polypropylene on at least a part of the surface of the island component in the island-in-sea type fiber or the first or second component in the orange or multiple bimetal type fiber or the like, a desired strength can be imparted to the fiber sheet or the fibers can be fixed by fusing the low-melting-point polymer components after generating the fine fibers. When the high-melting-point polypropylene component contains a polymer having a degree of shrinkage different from that of the high-melting-point polypropylene as one or more distinct portions or layers separated from one or more portions or layers of the high-melting-point polypropylene, for example, in the laminated or eccentric form, a pliability or stretchability can be imparted to the fiber sheet by heating the fine fibers generated from the island components or the first or second components to express crimps.

The low-melting-point polymer has a melting point lower than that of the high-melting-point polypropylene, preferably by 10° C. or more (i.e., the melting point=156° C. or less), more preferably by 20° C. or more (i.e., the melting point=146° C. or less), to ensure that the high-melting-point polypropylene is not melted upon fusing. The low-melting-point polymer may be, for example, a polyethylene, such as high-density polyethylene, medium-density polyethylene, low-density polyethylene, linear low-density polyethylene, or copolymeric polyethylene, copolymeric polypropylene, or polybutylene succinate.

The low-melting-point polymer constitutes at least a part of the surface of the island component in the islands-in-sea type conjugate fiber or the first or second component in the orange or multiple bimetal type conjugate fiber, to thus take part in the fusion. The low-melting-point polymer accounts for preferably 30% or more, more preferably 60% or more, of the surface of the island component in the islands-in-sea type conjugate fiber or the first or second component in the orange or multiple bimetal type conjugate fiber, to thus provide a better fusibility. The high-melting-point polypropylene preferably accounts for 25 mass % or more of the high-melting-point polypropylene component of the island component in the islands-in-sea type conjugate fiber or the first or second component in the orange or multiple bimetal type conjugate fiber. If the content of the high-melting-point polypropylene in the high-melting-point polypropylene component is less than 25 mass %, the high-melting-point polypropylene components are liable to bond with each other when cut.

The fine-fibers-generating parent fiber of the present invention contains non-polypropylene based components, in addition to the high-melting-point polypropylene components comprising the high-melting-point polypropylene and optionally the low-melting-point polymer. The non-polypropylene based components are contained in the parent fiber as the sea components of the islands-in-sea type conjugate fiber, or the second or first components of the orange or multiple bimetal type conjugate fiber.

The non-polypropylene based component as the sea component of the islands-in-sea type conjugate fiber may be made of, for example, a polymer material which can be removed in an amount of 95 mass % or more with a solvent which can remove 5 mass % or less of the polymer materials constituting the high-melting-point polypropylene components, such as the high-melting-point polypropylene and optionally the low-melting-point polymer. Specifically, the polymer material for the non-polypropylene based component may be, for example, polymers which may be removed with an aqueous alkaline solution, such as polyester, such as polyethylene terephthalate, polyethylene terephthalate based copolymer, polybutylene terephthalate, polybutylene terephthalate based copolymer, polyglycolic acid, glycolic acid based copolymer, polylactic acid, or lactic acid based copolymer, or polyethylene, such as low-density polyethylene, linear low-density polyethylene, medium-density polyethylene, high-density polyethylene, or a polyethylene based copolymer, or the combination thereof. Of these polymers, it is preferable to use polylactic acid or a polyester having an intrinsic viscosity of 0.6 or less which can be easily stretched and will enhance the crystallizability of the high-melting-point polypropylene by the drawing treatment. The intrinsic viscosity is measured, using a mixture of phenol and 1,1,2,2-tetrachloroethane (60:40, mass ratio) as a solvent, at 30° C. in an Ostwald viscometer.

The non-polypropylene based component as the second or first components of the orange or multiple bimetal type conjugate fiber may be made of, for example, a polymer material which has a poor compatibility with the polymer materials constituting the high-melting-point polypropylene components, such as the high-melting-point polypropylene, and optionally, the low-melting-point polymer. Specifically, the polymer material such a non-polypropylene based component may be, for example, a polyamide, such as nylon 6, nylon 66, or a nylon based copolymer, or polyester, such as polyethylene terephthalate, a polyethylene terephthalate based copolymer, a polybutylene terephthalate, a polybutylene terephthalate based copolymer, a polyglycolic acid, a glycolic acid based copolymer, a polylactic acid, or a lactic acid based copolymer, or a combination thereof.

In general, a nonwoven fabric prepared from fine fibers with almost the same diameter may have uniform pores and exhibit an excellent filtering performance. Therefore, the fine fibers generated from the parent fibers of the present invention preferably have almost the same diameter; namely, the island components, or the first or second components preferably have almost the same diameter. Specifically, in the preferred embodiment of the islands-in-sea type parent fiber of the present invention, a ratio (Si/Ai) of a standard deviation (Si) of a diameter distribution of the island components to an average (Ai) of the diameter of the island components is preferably 0.2 or less, more preferably 0.18 or less. Further, in the preferred embodiment of the orange or multiple bimetal type parent fiber of the present invention, a ratio (Si/Ai) of a standard deviation (Si) of a diameter distribution of the first or second components to an average (Ai) of the diameter of the first or second components is preferably 0.2 or less, more preferably 0.18 or less. As mentioned for the standard deviation (Si) as above, the average (Ai) of the diameter of the island components or the first or second components is determined by taking an electron photomicrograph of the parent fibers or the fine fibers generated therefrom, measuring the diameters of 100 or more components or fine fibers, and calculating the average value thereof. The standard deviation (Si) is calculated from the equation (2):

$$Si=\{(n\Sigma_{\chi}^{2}-(\Sigma_{\chi})^{2})/n(n-1)\}^{1/2} \quad (2)$$

wherein Si denotes a standard deviation, n denotes the number of the components or the fine fibers measured, and $\chi$ denotes a diameter of each of the components or the fine fibers measured.

The cross-sectional shape of the fine-fibers-generating parent fiber according to the present invention may be circular or non-circular, such as elliptic, T-shaped, Y-shaped, +-shaped, hollow, or polygonal. In the islands-in-sea type parent fiber according to the present invention, the island component may have a circular cross-section or non-circular cross-section, such as an elliptic, T-shaped, Y-shaped, +-shaped, hollow type, or polygonal cross-section. The polymeric material, such as the high-melting-point polypropylene, constituting the fine-fibers-generating parent fiber according to the present invention, may contain one or more functional materials, such as a hygroscopic agent, a matting agent, a pigment, a flame retardant, a stabilizer, an antistatic agent, a coloring agent, a dye, an agent imparting electrical conductivity, an agent imparting hydrophilicity, a deodorizing agent, or an antimicrobial agent, to thus possess various functions.

A fineness of the fine-fibers-generating parent fiber according to the present invention is not particularly limited, but is preferably about 0.8 to 10 denier. A fiber length of the fine-fibers-generating parent fiber according to the present invention is not particularly limited, but is preferably about 0.5 to 30 mm when the fine fibers suitable for a wet-laid method are generated, or 25 to 160 mm when the fine fibers suitable for a dry-laid method are generated.

The fine-fibers-generating parent fiber according to the present invention may be spun, using a conventional conjugate spinning process and/or polymer blend spinning process. For example, the islands-in-sea type parent fiber containing the island components of the high-melting-point polypropylene and the sea component of polylactic acid may be prepared by carrying out a spinning process at a melting-spinning temperature of 210 to 245° C. and then drawing the spun fibers. After the drawing treatment, the fine-fibers-generating parent fibers may be cut into shorter fibers suitable for the production of a nonwoven fabric. When the fine-fibers-generating parent fibers of the present invention are cut, the edges do not contain a bonding of the high-melting-point polypropylene components, because the parent fiber contains the high-melting-point polypropylene components. The fine-fibers-generating parent fibers of the present invention may be cut by a conventional method, using a conventional cutter such as a guillotine cutter, a rotary cutter, a shearing machine or the like. When the fine-fibers-generating parent fibers according to the present invention are used as a starting material of the dry-laid nonwoven fabric or as a spun yarn, it is preferable to mechanically or thermally impart a crimpability to the parent fibers at about 5 to 50 crimps/inch.

As the high-melting-point polypropylene used as a starting material of the fine-fibers-generating parent fiber, it is preferable to use a polypropylene resin having a molecular-weight distribution (weight-average molecular weight/number-average molecular weight) of 6 or less, more preferably 5 or less, so that the polypropylene constituting the fine-fibers-generating parent fiber has a melting point of 166° C. or more. Further, it is possible to raise the melting point of the polypropylene constituting the high-melting-point polypropylene components by drawing the fine-fibers-generating parent fiber at 90° C. or more, preferably at the highest possible temperature at which the fibers will not melt. It is preferable to use a polymer having an excellent drawability in combination with the polypropylene, so that the polypropylene constituting the fine-fibers-generating parent fiber has a melting point of 166° C. or more. The weight-average molecular weight and the number-average molecular weight may be measured by GPC (gel permeation chromatography) at 180° C., using 1,2,4-trichlorobenzene, as a converted molecular weight of polystyrene.

The fine-fibers-generating parent fiber containing the island components or the first or second components having almost the same diameter can be prepared by a conventional conjugate spinning process. For example, the islands-in-sea type parent fiber containing the island components having almost the same diameter may be prepared by extruding the island components from restricted nozzles at a spinning nozzle into the sea component, and forming a composition of the extruded components.

The fine fibers generated from the parent fiber of the present invention contain the high-melting-point polypropylene components. Therefore, the fine fibers are not bonded with each other when cut into shorter fibers, and the cut fine fibers are not bonded with each other. The fine fibers generated from the parent fibers can be uniformly dispersed after cutting. A process for generating the fine fibers from the parent fibers of the present invention varies with the parent fibers to be treated. For example, when the fine-fibers-generating parent fiber contains (1) the non-polypropylene based components which can be removed in an amount of 95 mass % or more with a solvent and (2) the high-melting-point polypropylene components which cannot be removed in an amount of 5 mass % or more with the same solvent, the high-melting-point fine fibers can be generated by immersing the parent fibers in the solvent. When the fine-fibers-generating parent fiber contains (1) the high-melting-point polypropylene components and (2) the polymer material having a poor compatibility with the polymer materials constituting the high-melting-point polypropylene components, the fine fibers can be generated by applying a force to the parent fiber by a fluid jet, a calender roll, a flat plate, or the like.

The fiber sheet of the present invention contains the fine fibers generated from the parent fiber. The fine fibers generated from the parent fiber can be uniformly dispersed, and thus, the fiber sheet, particularly a nonwoven fabric, containing the fine fibers exhibits an excellent texture. The fiber sheet containing the fused fine fibers has a desirable tensile strength and rigidity. When the fiber sheet contains fine fibers expressing crimps, it exhibits an excellent pliability and stretchability. The fiber sheet may be a woven fabric, a knitted fabric, a nonwoven fabric, or a composite fabric thereof.

The content of the fine fibers generated from the parent fibers in the fiber sheet is preferably 10 mass % or more, more preferably 20 mass % or more, most preferably 30 mass % or more, to ensure that properties such as a separating performance, pliability, or denseness, can be obtained from the presence of the fine fibers.

The fiber sheet may contain, in addition to the fine fibers generated from the parent fibers, conventional fibers, for example, inorganic fibers such as glass fibers or carbon fibers, natural fibers such as silk, wool, cotton or flax, regenerated fibers such as rayon fibers, semi-synthetic fibers such as acetate fibers, or synthetic fibers such as polyamide fibers, polyvinyl alcohol fibers, acrylic fibers, polyester fibers, polyvinyl chloride based fibers, polyvinylidene chloride fibers, polyurethane fibers, polyethylene fibers, polypropylene fibers, polymethylpentene fibers, aromatic polyamide fibers, or a conjugate fiber comprising a combination thereof and having a crimpable, heat-adhesive or divisible property.

The fiber sheet may be prepared by a conventional method. For example, a wet-laid nonwoven fabric containing the fine fibers generated from the parent fibers of the present invention may be prepared as follows: The fine fibers are prepared from the parent fibers. When the fine fibers are not short fibers, they may be cut to a desired length by a conventional method, using a conventional cutter such as a guillotine cutter, a rotary cutter, a shearing machine or the like. Then, a fiber web may be prepared from the fine fibers, and optionally, other fibers, by a conventional wet-laid method such as a Fourdinier paper machine, a cylinder paper machine, an oblique screen former, or an inclined wire machine. Thereafter, the fiber web is bonded to obtain a wet-laid nonwoven fabric. The bonding method may be, for example, (1) a method for entangling fibers by a fluid stream, such as a water jet, (2) a method for fusing the fibers with the fine fibers, and optionally, adhesive fibers, or (3) a method for bonding the fibers by spraying or coating a binder. The methods (1) to (3) may be used singly or in combination.

The fiber sheet contains uniformly dispersed fine fibers, and exhibits an excellent texture. Therefore, the fiber sheet can be used in many applications, for example, as an interlining cloth or a wadding for textiles, an interior finishing material, a gas or liquid filter material, a cleaning sheet, a civil engineering sheet, a battery separator, a substrate for a cold (hot) compress, a substrate for a wallpaper, a substrate for a synthetic leather, a substrate for an artificial leather, a waterproof fabric having a permeability to water vapor, or the like. The fiber sheet may be subjected to a coloring treatment with a dye or pigment, a nap-raising treatment, a laminating treatment, a fabricating treatment, an embossing treatment, a chemical or physical surface treatment, or the like, to impart various functions suitable for the intended applications.

EXAMPLES

The present invention will now be further illustrated by, but is by no means limited to, the following Examples. The melt index of polypropylene was measured in accordance with JIS K6758, and the melt index of polyethylene was measured in accordance with ASTM D1238.

Example 1

Islands-in-sea type fibers (fineness=1.5 denier; fiber length=3 mm) containing 25 island components of polypropylene in a sea component of poly-L-lactic acid (hereinafter sometimes referred to as "PLLA") were prepared by a conventional conjugate spinning. Then, the islands-in-sea type fibers were immersed in a bath of a 10 mass % sodium hydroxide aqueous solution at 80° C. for 30 minutes to dissolve and remove the sea component of PLLA, and then polypropylene fine fibers (average diameter=1.8 μm; standard deviation of a fiber size distribution=0.15; melting point=172° C.; fiber length=3 mm; not fibrillated; drawn) were formed.

As the adhesive fibers, sheath-core type conjugate fibers (diameter=11.8 μm; fiber length=10 mm; not fibrillated; drawn) containing a core component of polypropylene (melting point=158° C.) and a sheath component (adhesive component) of high-density polyethylene (melting point=131° C.) were used.

Then, the polypropylene fine fibers and the adhesive fibers (mass ratio=50:50) were dispersed in a dispersing bath of water, and a fiber web made by a standard sheet machine. The resulting fiber web was heated at 140° C. for drying, and at the same time, for fusing only the adhesive components in the adhesive fibers to obtain a nonwoven fabric wherein the constituent fibers were substantially 2-dimensionally oriented. The maximum pore size and the mean flow pore size of the resulting nonwoven fabric are shown in Table 1.

Example 2

Islands-in-sea type fibers (fineness=4.9 denier; fiber length=5 mm) containing 25 island components of polypropylene in a sea component of PLLA were prepared by a conventional conjugate spinning. Then, the islands-in-sea type fibers were immersed in a bath of a 10 mass % sodium hydroxide aqueous solution at 80° C. for 30 minutes to dissolve and remove the sea component of PLLA, and then polypropylene fine fibers (average diameter=3.8 μm; standard deviation of a fiber size distribution=0.21; melting point=167° C.; fiber length=5 mm; not fibrillated; drawn) were formed.

The procedures to make a fiber web and fuse only the adhesive components of the adhesive fibers as described in Example 1 were repeated except that a 50 mass % of the resulting polypropylene fine fibers were used, to obtain a nonwoven fabric wherein the constituent fibers were substantially 2-dimensionally oriented. The maximum pore size and the mean flow pore size of the resulting nonwoven fabric are shown in Table 1.

Example 3

Islands-in-sea type fibers (fineness=1.5 denier; fiber length=3 mm) containing 61 island components of polymethylpentene in a sea component of polyethylene terephthalate containing copolymer component of 5-sulfoisophthalate were prepared by a conventional conjugate spinning. Then, the islands-in-sea type fibers were immersed in a bath of a 10 mass % sodium hydroxide aqueous solution at 80° C. for 40 minutes to dissolve and remove the sea component of copolymeric polyester, and then polymethylpentene fine fibers (average diameter=1 μm; standard deviation of a fiber size distribution=0.15; melting point=234° C.; fiber length=3 mm; not fibrillated; drawn) were formed.

The procedures used to make a fiber web and fuse only the adhesive components of the adhesive fibers as described in Example 1 were repeated except that a 50 mass % of the resulting polymethylpentene fine fibers were used, to obtain a nonwoven fabric wherein the constituent fibers were substantially 2-dimensionally oriented. The maximum pore size and the mean flow pore size of the resulting nonwoven fabric are shown in Table 1.

Example 4

Islands-in-sea type fibers (fineness=1.3 denier; fiber length=3 mm) containing 25 island components of polypropylene in a sea component of PLLA were prepared by a conventional conjugate spinning. Then, the islands-in-sea type fibers were immersed in a bath of a 10 mass % sodium hydroxide aqueous solution at 80° C. for 30 minutes to dissolve and remove the sea component of PLLA, and then polypropylene fine fibers (average diameter=1.4 μm; standard deviation of a fiber size distribution=0.12; melting point=172° C.; fiber length=3 mm; not fibrillated; drawn) were formed.

As the adhesive fibers, sheath-core type conjugate fibers (diameter=17.5 μm; fiber length=10 mm; not fibrillated; drawn) containing a core component of polypropylene (melting point=164° C.) and a sheath component (adhesive component) of low-density polyethylene (melting point=105° C.) were used.

Then, the polypropylene fine fibers and the adhesive fibers (mass ratio=50:50) were dispersed in a dispersing bath of water, and a fiber web made by a standard sheet machine. The resulting fiber web was heated at 140° C. for drying, and at the same time, for fusing only the adhesive components in the adhesive fibers to obtain a nonwoven fabric wherein the constituent fibers were substantially 2-dimensionally oriented. The maximum pore size and the mean flow pore size of the resulting nonwoven fabric are shown in Table 1.

Example 5

Islands-in-sea type fibers (fineness=2 denier; fiber length=3 mm) containing 25 island components of polymethylpentene contained in high-density polyethylene in a sea component of polyethylene terephthalate containing a copolymer component of 5-sulfoisophthalate were prepared by a conventional conjugate spinning. Then, the islands-in-sea type fibers were immersed in a bath of a 10 mass % sodium hydroxide aqueous solution at 80° C. for 45 minutes to dissolve and remove the sea component of copolymeric polyethylene terephthalate, and then islands-in-sea type fine fibers (average diameter=1.3 μm; standard deviation of a fiber size distribution=0.11; fiber length=3 mm; not fibrillated; drawn) of polymethylpentene (island component; melting point=232.3° C.) contained in high-density polyethylene (sea component; melting point=126.7° C.) were formed.

The procedures used to make a fiber web as described in Example 1 were repeated except that 50 mass % of the resulting islands-in-sea type fine fibers were used and the adhesive components in the adhesive fibers and the adhesive components (high-density polyethylene) in the islands-in-sea type fine fibers were fused, to obtain a nonwoven fabric wherein the constituent fibers were substantially 2-dimensionally oriented. The maximum pore size and the mean flow pore size of the resulting nonwoven fabric are shown in Table 1. The surface of the nonwoven fabric was observed in the electron micrograph thereof to find that all of the crossings of the adhesive fibers and the islands-in-sea fine fibers were fused. When the surface of the nonwoven fabric was rubbed with a finger-tip, a nap was not produced.

Comparative Example 1

The procedure of Example 4 was repeated except that the polypropylene fine fibers used in Example 4 and the adhesive fibers used in Example 4 were used in a mass ratio of 7:3, to obtain a nonwoven fabric. Then, to both sides of the resulting nonwoven fabric, a water jet was alternately applied twice from a nozzle plate containing a line of nozzles having a diameter of 0.3 mm and a pitch of 0.6 mm under a pressure of 0.3 MPa to obtain a nonwoven fabric wherein the constituent fibers were substantially 3-dimensionally entangled. The maximum pore size and the mean flow pore size of the resulting nonwoven fabric are shown in Table 1.

Comparative Example 2

The procedures used to make a fiber web and fuse only the adhesive components of the adhesive fibers as described in Example 1 were repeated except that, as the adhesive fibers, 50 mass % of sheath-core type conjugate fibers (diameter=23.3 $\mu$m; fiber length=10 mm; not fibrillated; drawn) containing a core component of polypropylene (melting point=162° C.) and a adhesive sheath component of high-density polyethylene (melting point=132° C.) were used, to obtain a nonwoven fabric wherein the constituent fibers were substantially 2-dimensionally oriented. The maximum pore size and the mean flow pore size of the resulting nonwoven fabric are shown in Table 1.

Comparative Example 3

Islands-in-sea type fibers (fineness=3.4 denier; fiber length=3 mm) containing 25 island components of polypropylene in a sea component of PLLA were prepared by a conventional conjugate spinning. Then, the islands-in-sea type fibers were immersed in a bath of a 10 mass % sodium hydroxide aqueous solution at 80° C. for 30 minutes to dissolve and remove the sea component of PLLA, and then polypropylene fine fibers (average diameter=3 $\mu$m; standard deviation of a fiber size distribution=0.19; melting point=168° C.; fiber length=3 mm; not fibrillated; drawn) were formed.

As the adhesive fibers, sheath-core type conjugate fibers (diameter=11.8 $\mu$m; fiber length=10 mm; not fibrillated; drawn) containing a core component of polypropylene (melting point=158° C.) and a sheath component (adhesive component) of high-density polyethylene (melting point=131° C.) were used.

Further, as fibrillated fine fibers, aramid fine fibers (KY400S, Daicel Chemical Industries, Ltd.) were used.

Then, the polypropylene fine fibers, the adhesive fibers and the aramid fine fibers (mass ratio=3:5:2) were dispersed in a dispersing bath of water, and a fiber web made by a standard sheet machine. The resulting fiber web was heated at 140° C. for drying, and at the same time, for fusing only the adhesive components in the adhesive fibers to obtain a nonwoven fabric wherein the constituent fibers were substantially 2-dimensionally oriented. However, the fine fibers were entangled in the wires, and the mass of the resulting fiber web was less than the mass of the fibers poured into the dispersing bath. Further, a fiber distribution in the resulting nonwoven fabric was not uniform and the texture was poor.

Example 6

The nonwoven fabric prepared in Example 1 was pressed between a calender having a metal roll and a resin roll at 80° C. under a linear pressure of 1764 N/cm, to obtain a filter material. The maximum pore size and the mean flow pore size of the resulting filter material are shown in Table 2.

Example 7

The nonwoven fabric prepared in Example 3 was pressed between a calender having a metal roll and a resin roll at 80° C. under a linear pressure of 1764 N/cm, to obtain a filter material. The maximum pore size and the mean flow pore size of the resulting filter material are shown in Table 2.

Example 8

The nonwoven fabric prepared in Example 4 was pressed between a calender having a metal roll and a resin roll at 80° C. under a linear pressure of 1764 N/cm, to obtain a filter material. The maximum pore size and the mean flow pore size of the resulting filter material are shown in Table 2.

Example 9

The nonwoven fabric prepared in Example 5 was pressed between a calender having a metal roll and a resin roll at 80° C. under a linear pressure of 1764 N/cm, to obtain a filter material. The maximum pore size and the mean flow pore size of the resulting filter material are shown in Table 2.

Comparative Example 4

The nonwoven fabric prepared in Comparative Example 1 was pressed between a calender having a metal roll and a resin roll at 80° C. under a linear pressure of 1764 N/cm, to obtain a filter material. The maximum pore size and the mean flow pore size of the resulting filter material are shown in Table 2.

Evaluation (1) Determination of Resistance to Permeation of Liquid

To determine the resistance to a permeation of liquid, a pressure loss was measured when a water stream was passed at a rate of 1.5 L/minute through the filter materials (effective area=51.5 $cm^2$) prepared in Examples 6 to 9 and Comparative Example 4. The results are shown in Table 2.

(2) Determination of Diameters of Captured Solids

A test dispersion containing 11 kinds of dust particles stipulated in JIS in a concentration of 10 ppm was uniformly stirred. The number (A) of the dust particles contained in the test dispersion was counted for each particle size range, using a particle counter. Thereafter, the stirred test dispersion was passed at a rate of 1.5 L/minute through the filter materials (effective area=51.5 $cm^2$) prepared in Examples 6 to 9 and Comparative Example 4. After 1 minute, filtrates were taken and the number (B) of the dust particles contained in the filtrates was counted for each particle size range using a particle counter (Coulter counter Multisizer II). The efficiency of the capture for each particle size range was calculated from the equation (3):

$$C(\%)=[(A-B)/A]\times 100 \quad (3)$$

wherein C denotes an efficiency of capture, A denotes the number of dust particles contained in the test dispersion, and B denotes the number of dust particles contained in the filtrate. A minimum particle size of the dust particles showing the efficiency of capture of 100% was defined as the diameter (μm) of the captured solids, when all of the dust particles having larger particle sizes show an efficiency of capture of 100% at the same time. For example, the "diameter of capture solid" is "c" (μm), when the efficiencies of capture and particle sizes ("a" to "g") are as follows:

| Efficiency of capture (%) | Particle size (μm) (a > b > c > d > e > f > g) |
|---|---|
| 100 | a or more |
| 100 | b |
| 100 | c |
| 99 | d |
| 100 | e |
| 97 | f |
| 95 | g or less |

The results are shown in Table 2.

(3) Determination of Filtering Lifetime

A test dispersion containing 11 kinds of dust particles stipulated in JIS in a concentration of 10 ppm was passed with stirring at a rate of 1.5 L/minute through the filter materials (effective area=51.5 $cm^2$) prepared in Examples 6 to 9 and effective Example 4. The total amount of the test dispersion treated by the filter materials until a difference from an initial pressure loss became 2 $kg/cm^2$ was defined as the filtering lifetime. The results are shown in Table 2.

Table 2 shows that the filter material of the present invention captures solids having a small diameter, exhibits an excellent filtering performance, and has a long lifetime, although it has a low resistance to a permeation of liquid. Further, even when the nonwoven fabric of the present invention has a slightly high resistance to a permeation of liquid, it still provides captured solids having a small diameter, exhibits an excellent filtering performance, and has a long lifetime.

Example 10

Undrawn fibers (fineness=4.2 denier) were spun by extruding the sea component of poly-L-lactic acid and the island components of polypropylene (melt index=65: molecular weight distribution=5.1) in a gear-pump ratio (volume ratio) of 75:25 at 240° C., using a conventional conjugate spinning apparatus capable of spinning islands-in-sea conjugate fibers containing 25 island components. Then, the undrawn fibers were drawn at 90° C. to 3.4 times, and the drawn fibers were cut by a guillotine cutter to obtain short fine-fibers-generating parent fibers [fineness=1.2 denier, fiber length=3 mm, cross-section=circle; diameters of island components=1.7 μm or less, ratio (Si/Ai) of a standard deviation (Si) of a diameter distribution of the island components to an average (Ai) of the diameters of the island components=0.085 (n=100), cross-section of the island components=circle]. An electron micrograph of the cut edge of the resulting short fine-fibers-generating parent fiber revealed that the long fine-fibers-generating parent fiber were cut without bonding due to the pressure applied.

The sea component of poly-L-lactic acid was dissolved and removed by immersing the short fine-fibers-generating parent fibers in 1 M sodium hydroxide aqueous solution at 80° C. for 30 minutes to obtain polypropylene fine fibers [average fiber diameter=1.2 μm, ratio (Sf/Af) of a standard deviation (Sf) of a fiber size distribution of the fine fibers to an average (Af) of the diameters of the fine fibers=0.085 (n=100), cross-section=circle]. The melting point of the short polypropylene fine fiber was measured by a differential

TABLE 1

| | Maximum pore size (A, μm) | Mean flow pore size (B, μm) | Ratio (A/B) | Area density ($g/m^2$) | Thickness (mm) | Apparent density ($g/cm^3$) |
|---|---|---|---|---|---|---|
| Example 1 | 20.7 | 12.1 | 1.7 | 37.7 | 0.34 | 0.11 |
| Example 2 | 41.0 | 21.6 | 1.9 | 37.6 | 0.39 | 0.096 |
| Example 3 | 6.2 | 4.2 | 1.5 | 35.4 | 0.22 | 0.16 |
| Example 4 | 8.9 | 5.3 | 1.7 | 36.2 | 0.31 | 0.12 |
| Example 5 | 8.2 | 4.9 | 1.7 | 36.3 | 0.28 | 0.13 |
| Comparative Example 1 | 12.4 | 5.5 | 2.3 | 37.5 | 0.28 | 0.13 |
| Comparative Example 2 | 23.4 | 11.3 | 2.1 | 36.8 | 0.29 | 0.13 |

TABLE 2

| | Maximum pore size (A, μm) | Mean flow pore size (B, μm) | Ratio (A/B) | Resistance to permeation of liquid (kg/cm) | Diameter of captured solids (μm) | Filtering lifetime (L) | Area density ($g/m^2$) | Thickness (mm) | Apparent density ($g/cm^3$) |
|---|---|---|---|---|---|---|---|---|---|
| Example 6 | 6.6 | 4.1 | 1.6 | 0.33 | 2.57 | 25 | 37.7 | 0.070 | 0.54 |
| Example 7 | 2.9 | 2.0 | 1.5 | 0.77 | 1.81 | 29 | 35.4 | 0.073 | 0.48 |
| Example 8 | 4.0 | 2.6 | 1.5 | 0.58 | 2.57 | 20 | 36.2 | 0.067 | 0.54 |
| Example 9 | 3.7 | 2.5 | 1.5 | 0.60 | 2.30 | 22 | 36.3 | 0.068 | 0.53 |
| Comparative Example 4 | 4.5 | 2.1 | 2.1 | 0.68 | 3.15 | 8 | 37.5 | 0.071 | 0.53 |

It is apparent from Table 1 that the nonwoven fabric of the present invention exhibits a good texture, and has a narrow distribution of the particle sizes; namely the maximum pore size is not more than twice a mean flow pore size. Further, scanning calorimeter to find 170.3° C. Thereafter, the short polypropylene fine fibers were poured into water containing a copolymer of acrylamide and sodium acrylate (thickener) and polyoxyethylene nonylphenyl ether (surface active agent). The fibers were uniformly dispersed without forming an aggregated mass thereof.

Example 11

Undrawn fibers (fineness=4.1 denier) were spun by extruding the sea component of poly-L-lactic acid. and the island components of polypropylene (melt index=65: molecular weight distribution=5.1) in a gear-pump ratio of 50:50 at 240° C., using a conventional conjugate spinning apparatus capable of spinning islands-in-sea conjugate fibers containing 25 island components. Then, the undrawn fibers were drawn at 90° C. to 3.3 times, and the drawn fibers were cut by a guillotine cutter to obtain short fine-fibers-generating parent fibers [fineness=3.4 denier, fiber length=3 mm, cross-section=circle; diameters of island components=3.5 μm or less, ratio (Si/Ai) of a standard deviation (Si) of a diameter distribution of the island components to an average (Ai) of the diameters of the island components=0.053 (n=100), cross-section of the island components=circle]. An electron micrograph of the cut edge of the resulting short fine-fibers-generating parent fiber revealed that the long fine-fibers-generating parent fiber were cut without bonding due to the pressure applied.

The sea component of poly-L-lactic acid was dissolved and removed by immersing the short fine-fibers-generating parent fibers in 1 M sodium hydroxide aqueous solution at 80° C. for 30 minutes to obtain polypropylene fine fibers [average fiber diameter=3 μm, ratio (Sf/Af) of a standard deviation (Sf) of a fiber size distribution of the fine fibers to an average (Af) of the diameters of the fine fibers=0.053 (n=100), cross-section=circle]. The melting point of the short polypropylene fine fiber was measured by a differential scanning calorimeter and was found to be 168.0° C. Thereafter, the short polypropylene fine fibers were poured as in Example 10. The fibers were uniformly dispersed without forming an aggregated mass thereof.

Comparative Example 5

Undrawn fibers (fineness=3 denier) were spun by extruding the sea component of polyethylene terephthalate copolymer (intrinsic viscosity=0.54) with a copolymer component of 5-sulfoisophthalic acid and the island components of polypropylene (melt index=21: molecular weight distribution=6.3) in a gear-pump ratio of 91:39 at 295° C., using a conventional conjugate spinning apparatus capable of spinning islands-in-sea conjugate fibers containing 25 island components. Then, the undrawn fibers were drawn at 90° C. to 1.9 times, and the drawn fibers were cut by a guillotine cutter to obtain short fine-fibers-generating parent fibers [fineness=1.7 denier, fiber length=3 mm, cross-section=circle; diameters of island components=1.8 μm or less, ratio (Si/Ai) of a standard deviation (Si) of a diameter distribution of the island components to an average (Ai) of the diameters of the island components=0.14 (n=100), cross-section of the island components=circle]. An electron micrograph of the cut edge of the resulting short fine-fibers-generating parent fiber revealed that the island components were bonded with each other on the surface of the cut edge.

The sea component of polyethylene terephthalate copolymer was dissolved and removed by immersing the short fine-fibers-generating parent fibers in a 1 M sodium hydroxide aqueous solution at 80° C. for 45 minutes, to obtain polypropylene fine fibers [average fiber diameter=1.1 μm, ratio (Sf/Af) of a standard deviation (Sf) of a fiber size distribution of the fine fibers to an average (Af) of the diameters of the fine fibers=0.14 (n=100), cross-section=circle]. The melting point of the short polypropylene fine fiber was measured by a differential scanning calorimeter and was found to be 164.4° C. Thereafter, the short polypropylene fine fibers were poured as in Example 10. The fibers were not dispersed but remained as bundles of fibers, and entangled masses were observed.

Example 12

Undrawn fibers (fineness=8 denier) were spun by extruding the sea component of poly-L-lactic acid and the island components composed of 40 mass % of polypropylene (melt index=65: molecular weight distribution 5.1) and 60 mass % of high-density-polyethylene (melt index=20) in a gear-pump ratio of 50:50 at 240° C., using a conventional conjugate spinning apparatus capable of spinning islands-in-sea conjugate fibers containing 25 island components. Then, the undrawn fibers were drawn at 90° C. to 2.4 times, and the drawn fibers were cut by a guillotine cutter to obtain short fine-fibers-generating parent fibers [fineness=3.5 denier, fiber length=3 mm, cross-section=circle; diameters of island components=1.7 μm or less, ratio (Si/Ai) of a standard deviation (Si) of a diameter distribution of the island components to an average (Ai) of the diameters of the island components=0.11 (n=100), cross-section of the island components=circle]. An electron micrograph of the cut edge of the resulting short fine-fibers-generating parent fiber revealed that the long fine-fibers-generating parent fiber were cut without bonding due to the pressure applied.

The sea component of poly-L-lactic acid was dissolved and removed by immersing the short fine-fibers-generating parent fibers in 1 M sodium hydroxide aqueous solution at 80° C. for 30 minutes to obtain polypropylene/high-density polyethylene fine fibers [average fiber diameter=1.2 μm, ratio (Sf/Af) of a standard deviation (Sf) of a fiber size distribution of the fine fibers to an average (Af) of the diameters of the fine fibers=0.11 (n=100), cross-section=circle, high-density polyethylene accounting for 60% or more of the fiber surface]. The melting points of the polypropylene component and the high-density polyethylene component were measured by a differential scanning calorimeter and were found to be 168.7° C. for the polypropylene component and 129.8° C. for the high-density polyethylene component. Thereafter, the short fine fibers were poured as in Example 10. The fibers were uniformly dispersed without forming an aggregated mass of fibers.

Example 13

The polypropylene/high-density polyethylene fine fibers prepared in Example 12, and sheath-core type conjugate adhesive short fibers (fiber diameter=11.8 μm, fiber length=10 mm) containing a core component of polypropylene (melting point=158° C.) and a sheath component (adhesive component) of high-density polyethylene (melting point=131° C.) were dispersed at a mass ratio of 1:1 in a dispersion medium of water containing acrylamide-sodium acrylate copolymer (thickener) and polyoxyethylene nonylphenyl ether (surface active agent), and then a fiber web was made by a standard sheet machine. The resulting fiber web was heated at 140° C. for drying, and at the same time, for fusing the adhesive components in the sheath-core type conjugate adhesive short fibers and the high-density polyethylene components in the polypropylene/high-density polyethylene fine fibers to obtain a nonwoven fabric. The resulting nonwoven fabric had a uniform texture and uniform pore sizes, and therefore was suitable for use as a gas or liquid filter material or a battery separator.

Although the present invention has been described with reference to specific embodiments, various changes and modifications obvious to those skilled in the art are deemed to be within the spirit, scope, and concept of the invention.

What we claim is:

1. A nonwoven fabric prepared from fibers which are not substantially fibrillated and have a diameter of less than 20 μm, by fusing the fiber web comprising fine fibers having a diameter of 4 μm or less, and adhesive fibers having a diameter ranging from 8 μm to less than 20 μm, wherein the maximum pore size in said nonwoven fabric is not more than twice a mean flow pore size of said nonwoven fabric and wherein the ratio (Sf/Af) of a standard deviation (Sf) of a fiber size distribution of said fine fibers to an average (Af) of the diameter of the fine fibers does not exceed 0.2.

2. The nonwoven fabric according to claim 1, containing fibers laid 2-dimensionally therein.

3. The nonwoven fabric according to claim 1, wherein said fine fiber contains an adhesive component, and said fine fibers constituting said nonwoven fabric are fused by said adhesive components.

4. The nonwoven fabric according to claim 1, wherein the fiber constituting said nonwoven fabric contains a adhesive component and a component having a melting point higher than that of said adhesive component, and said nonwoven fabric is fused by said adhesive component.

5. The nonwoven fabric according to claim 1, wherein said fine fiber contains an adhesive component and a component having a melting point higher than that of said adhesive component, and said nonwoven fabric is fused by said adhesive component.

6. The nonwoven fabric according to claim 1, wherein the fiber length of said fibers ranges from 0.5 to 30 mm.

* * * * *